US011103423B2

(12) United States Patent
Reynolds

(10) Patent No.: US 11,103,423 B2
(45) Date of Patent: Aug. 31, 2021

(54) PACIFIER BALL

(71) Applicant: Anna H. Reynolds, Fort Mill, SC (US)

(72) Inventor: Anna H. Reynolds, Fort Mill, SC (US)

( * ) Notice: Subject to any disclaimer, the term of this patent is extended or adjusted under 35 U.S.C. 154(b) by 289 days.

(21) Appl. No.: 16/270,812

(22) Filed: Feb. 8, 2019

(65) Prior Publication Data

US 2019/0240116 A1 Aug. 8, 2019

Related U.S. Application Data

(60) Provisional application No. 62/627,823, filed on Feb. 8, 2018.

(51) Int. Cl.
*A61J 17/00* (2006.01)

(52) U.S. Cl.
CPC ..... *A61J 17/001* (2015.05); *A61J 17/10* (2020.05); *A61J 17/105* (2020.05); *A61J 17/1111* (2020.05)

(58) Field of Classification Search
CPC ..... A61J 17/001; A61J 17/02; A61J 17/10; A61J 17/105; A61J 17/109; A61J 17/1111
See application file for complete search history.

(56) References Cited

U.S. PATENT DOCUMENTS 1,268,470 A 6/1918 Johnson
3,601,129 A 8/1971 Seidl
5,843,128 A 12/1998 Wexler
6,063,107 A 5/2000 Wexler
6,436,125 B1 8/2002 Rhoads
D764,673 S 8/2016 Guan
9,744,104 B1 * 8/2017 Weston ..... A61J 17/02
2005/0251211 A1 11/2005 Knifong
2010/0179593 A1 7/2010 Lamar

* cited by examiner

*Primary Examiner* — Katherine M Shi
(74) *Attorney, Agent, or Firm* — Memminger E. Wiggins

(57) ABSTRACT

A pacifier ball comprising a hollow sphere comprising a pair of identical hemispherical members having circular hemispherical rims separably joined together to form the hollow sphere. A first pair of hollow pliable nipples being mounted on and projecting radially outward, from one of the hemispherical members. The nipples of the first pair of hollow pliable nipples having centerlines projecting through the center of said sphere and defining therewith a first common plane. A second pair of hollow pliable nipples being mounted on and projecting radially outward from the other hemispherical member. The nipples of the second pair of hollow pliable nipples having centerlines projecting through the center of said sphere and defining therewith a second common plane. The centerlines of the nipples of each pair of hollow pliable nipples creating an angle of separation between the nipples and equal angles of projection for each of the nipples such that each of the nipples is equally spaced from its respective hemispherical rim. The first and second common planes being perpendicular to each other, and therefore each pair of hollow pliable nibbles are oriented perpendicular to each other on their respective hemispherical member. The size, weight, number and placement of the nipples facilitate the ease of use of the pacifier ball by an infant. The pacifier ball can also be taken apart for cleaning.

12 Claims, 5 Drawing Sheets

PACIFIER BALL

CROSS-REFERENCE TO RELATED APPLICATIONS

This application claims priority to and incorporates by reference herein U.S. Provisional Patent Application No. 62/627,823 filed on Feb. 8, 2018 and titled "Pacifier Ball".

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO SEQUENCE LISTING, A TABLE, OR A COMPUTER PROGRAM LISTING SUBMITTED ON A COMPACT DISC WITH APPENDIX

Not Applicable.

FIELD OF THE INVENTION

The present invention, a pacifier ball, relates to the field of devices used in the care of infants, and more specifically to those devices which infants suckle for security and comfort.

Pacifiers are often used by parents to satisfy the comforting suckling needs of their infant. Most pacifiers comprise a nipple end for suckling and a handle apparatus of some kind or fashion at the opposite end of the nipple for holding the pacifier.

When a pacifier comes out of an infant's mouth, the infant is no longer able to suckle and becomes distressed and begins to cry. Because the infant lacks the necessary motor control and dexterity in his or her hand and fingers to put the nipple end of a pacifier into its mouth, a parent, or other care taker, must discontinue any activity in which he or she may be engaged, or wake up during the night, to put the pacifier nipple into the infant's mouth. The pacifier ball overcomes the infant's undeveloped motor skills and lack of hand and finger dexterity to reduce the need for a parent to replace a pacifier nipple which has come out of the infant's mouth.

SUMMARY OF THE INVENTION

The present invention is a multi nipple pacifier having four pacifier nipples that extend from the surface of a centralized hollow support sphere. The lack of a handle on the pacifier ball together with the configuration of the nipples present a high probability of the infant easily reinserting a nipple into its mouth should it become necessary. The nipples are arranged and spaced such that no adjacent nipple will come into contact with the infant's nose to obstruct the infant's breathing when the infant is suckling a nipple on the pacifier ball. Additionally, the extended nipples prevent the pacifier ball from rolling or bouncing away from the infant and thereby insuring that the pacifier ball with its multiple nipples remains in close proximity of the infant and readily re-insertable by the infant. In the event an infant accidently stops suckling a nipple, the size and light weight of the present invention increase the probability that an infant will be able to find and resume suckling a nipple without having to disturb a parent or caregiver to assist the infant. The present invention has a simple design and can be manufactured from readily available materials both details of which can aid in lowering the cost of manufacture for the pacifier ball.

The pacifier ball is a multi nipple pacifier comprising a hollow sphere comprising a pair of identical hemispherical members having hemispherical rims separably joined together to form a hollow sphere: A first pair of hollow pliable nipples is mounted on and projects radially outward from one of the hemispherical members. The nipples of the first pair of hollow pliable nipples having centerlines projecting through the center of the hollow sphere and defining therewith a first common plane. A second pair of hollow pliable nipples is mounted on and projects radially outward from the other hemispherical member. The nipples of the second pair of hollow pliable nipples having centerlines projecting through the center of the hollow sphere and defining therewith a second common plane. The centerlines of the nipples of each pair of hollow pliable nipples create an angle of separation between the nipples and equal angles of projection for each of the nipples such that each of the nipples is equally spaced from its respective hemispherical rim. The first and second common planes being perpendicular to each other, and therefore each pair of hollow pliable nibbles are oriented perpendicular to one another on their respective hemispherical member.

One object of the present invention is to provide a multi nipple pacifier that be managed by the infant having limited dexterity and motor control of his or her hands.

Another object of the present invention is to provide a multi nipple pacifier can be safely used by an infant.

Another object of the present invention is to provide multi nipple pacifier that is simple to use.

Yet another object of the present invention is to provide a multi nipple pacifier that can be manufactured economically.

Another object of the invention is to provide a multi nipple pacifier that can be disassembled for cleaning.

Another object of the present, invention is to provide a multi nipple pacifier that is soothing to an infant when suckling These and other objects of the present invention are achievable due to simple design and functional configuration of the present invention. These and other objects of the present invention can be obtained in the preferred embodiments of the invention described below.

DETAILED DESCRIPTION OF THE INVENTION

Figure 1:
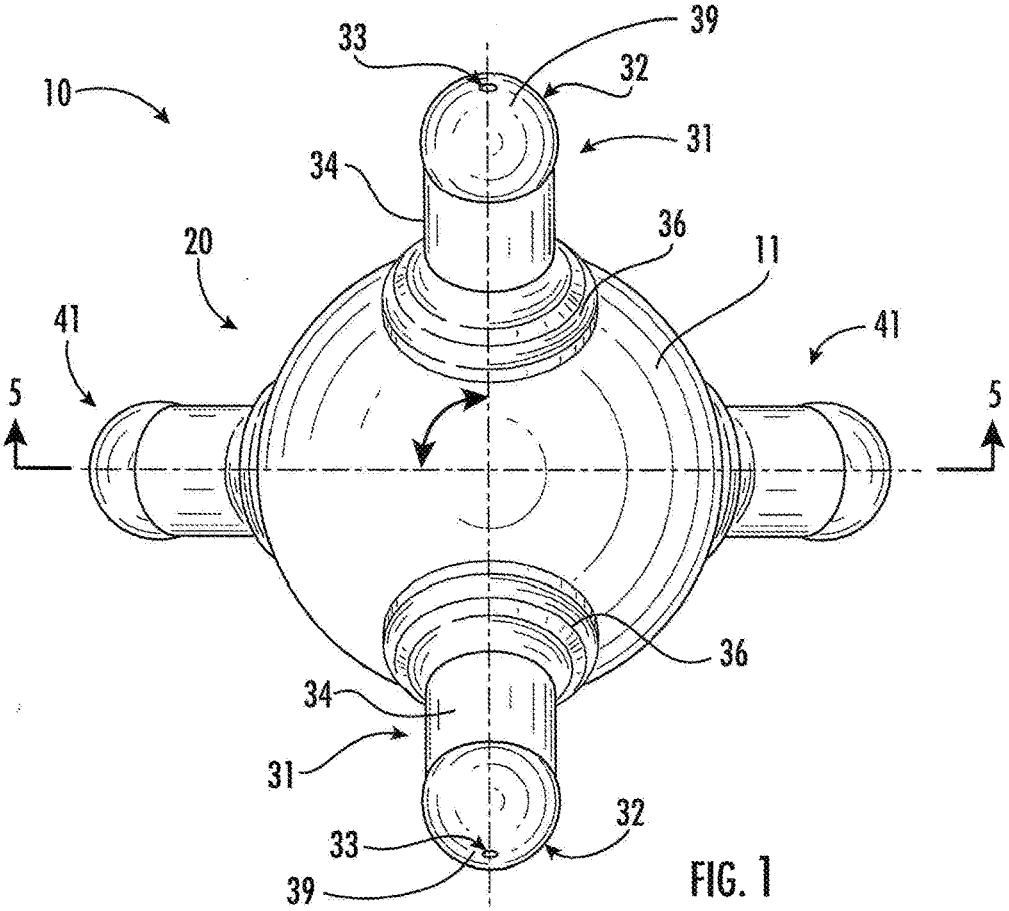
FIG. 1 is a top plan view of the present invention.
Figure 2:
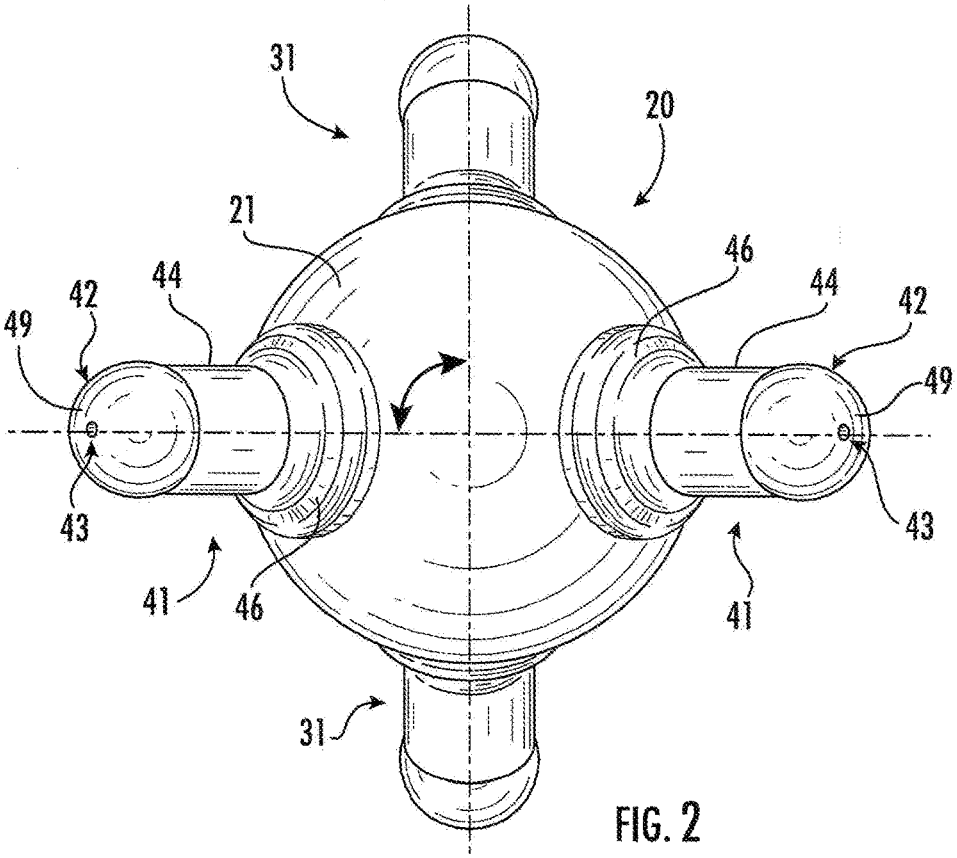
FIG. 2 is a bottom plan view of the present invention.
Figure 3A:
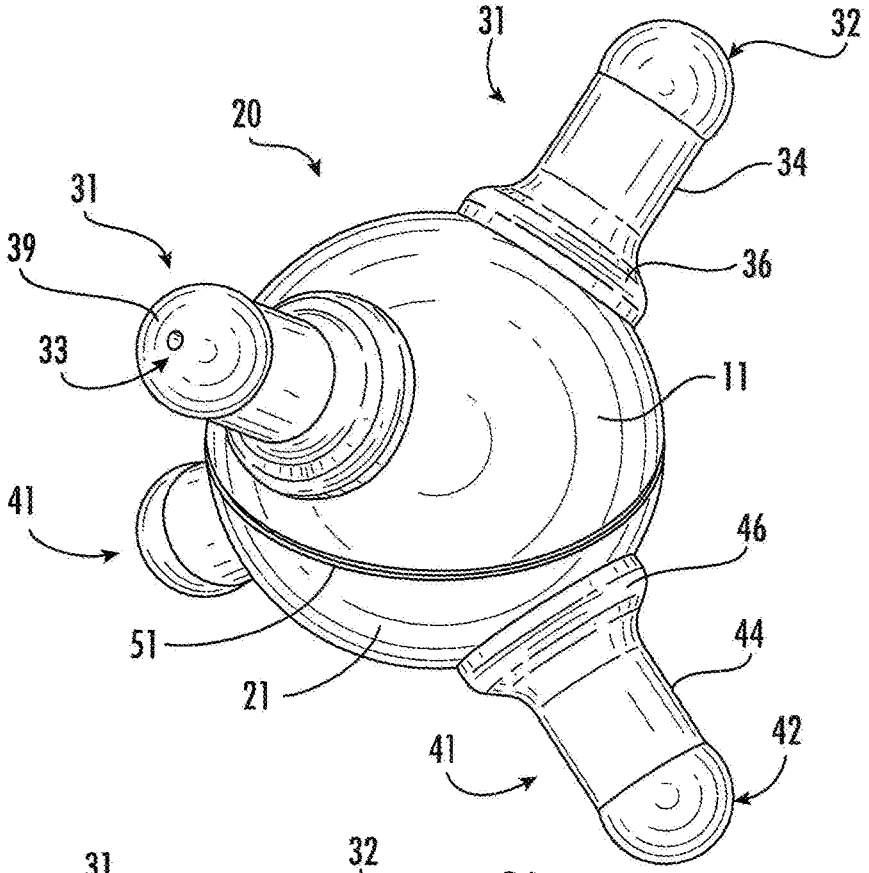
FIG. 3A is an upper perspective view of the present invention rotated to the left.
Figure 3B:
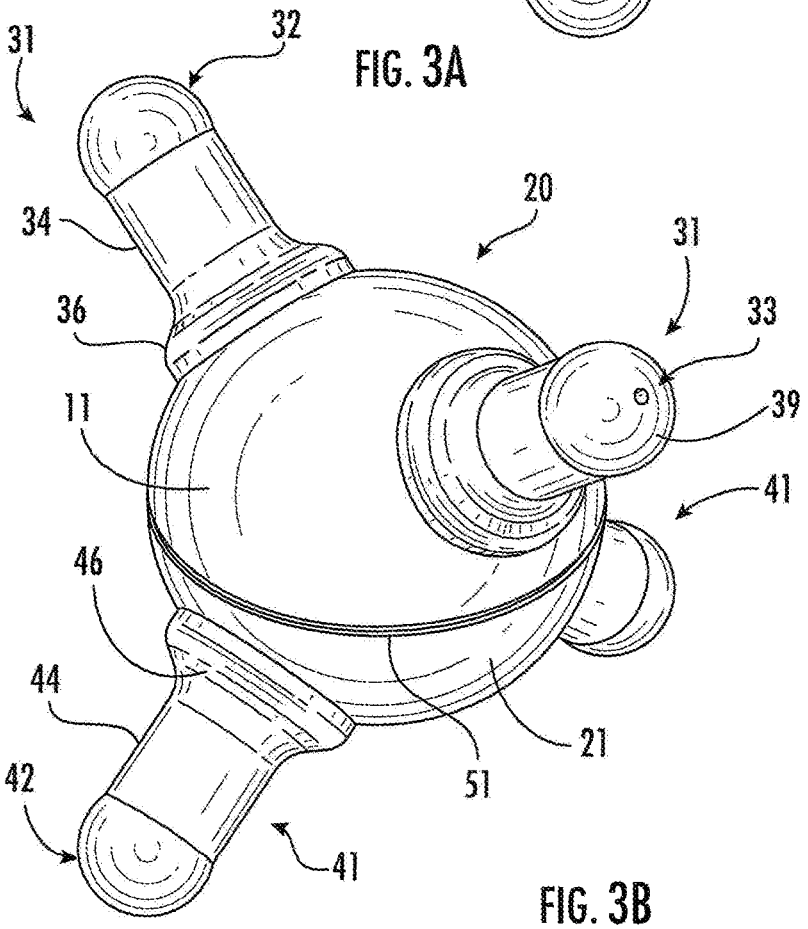
FIG. 3B is an upper perspective view of the present invention rotated to the right.

Reference will now be made in detail to one exemplary embodiment of the present invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the intended invention. Other objects, features, and aspects of the present invention are disclosed in the following detailed description. It is to be understood by one of ordinary skill in the art that the present discussion is a description of one exemplary embodiment only and is not intended as limiting the broader aspects of the present invention.

In describing the various figures herein, the same reference numbers are used throughout to describe the same material or apparatus, or process pathway. To avoid redundancy, detailed descriptions of much of the apparatus once described in relation to a figure may not be repeated in the descriptions of subsequent figures, although such apparatus or process is labeled with the same reference numbers.

A pacifier ball being a multi nipple pacifier according to a preferred embodiment of the present inventions is illustrated in FIGS. 1 to 6. One exemplary embodiment of the present invention can be generally described as a multi nipple pacifier for infants comprising specifically designed components with some components having a unique spacial relation to one another. In accordance with the present invention a pacifier ball for infants comprising a hollow sphere 20 having first and second hemispherical members 11, 21 with each hemispherical member having a pair of nipple openings 12 22, first and second pairs of hollow pliable nipples 31, 41 adapted to extend outwardly from the nipple openings 12, 22, and a means to secure 53 the first hemispherical member 11 to the second hemispherical member 21 such that the first pair of hollow pliable nipples 31 are oriented in a perpendicular fashion to the second pair of hollow pliable nipples 41. Additionally, the present invention includes a means for equalization of air pressure within said hollow sphere to prevent the invention from collapsing due to a change in air pressure such as when travelling by airplane.

Now referring to FIGS. 1, 2, 3A, 3B, 4, 5, and 6, in accordance with the present invention a pacifier ball 10 for infants is provided herein comprising a hollow sphere 20 having first and second hemispherical members 11, 21. The first hemispherical member 11 having a first pair of nipple openings 12 defined by a first pair of nipple opening rims 13, a first hemispherical rim 14, a first hemispherical outer surface 17, and a first hemispherical inner surface 16. In similar manner to the first hemispherical member 11 the second hemispherical member 21 is a duplicate of the first hemispherical member comprising a second pair of nipple openings 22 defined by a second pair of nipple opening rims 23, a second hemispherical rim 24, a second hemispherical outer surface 27, and a second hemispherical inner surface 26, wherein each of said second pair of nipple openings 22 having a diameter equal to said diameters of said first pair of nipple openings 12. Additionally, the first pair of nipple openings 12 and the second pair of nipple openings 22 all have the same diameter. In a preferred embodiment of the present invention the hemispherical members 11, 21 are manufactured from one of the available polymeric materials. Such polymers can provide a lightweight structure together with a degree of firmness. Also, the lighter the weight of the pacifier ball the easier it will be for the infant to hold and manipulate the device. In order to provide a surface that is soft and pleasant to the touch of an infant the polymeric hemispheric members are over-molded with a soft silicone layer. Also, in a preferred embodiment of the present invention to diameter of the hollow sphere of the present invention is about 1.68 inches. A hollow sphere 20 having a smaller diameter may increase the risk of an infant being able to put the pacifier ball in its mouth and becoming choked as well as the nipples being too close to one another.

The preferred embodiment of the present invention includes a first pair of hollow pliable nipples 31 mounted to the first hemispherical member 11 with each nipple having 1) a bulbous outer end 32 which has an outermost tip portion 39, 2) a tubular stem portion 34 connecting the bulbous outer end to a nipple shoulder 36 with the nipple shoulder being adapted to securely engage the first hemispherical outer surface 17, 3) a retaining groove 37 is adjacent to said nipple shoulder 36 said and is adapted to securely engage the nipple opening rim 13 of the nipple opening 12, and 4) a circular flanged inner end 38 adjacent to the retaining groove 37 with the circular flanged inner end adapted to securely engage the first hemispherical inner surface 16 of the first hemispherical member 11. The stein portion 34 of the nipples are sufficiently sized relative to the infant's mouth to prevent choking. Additionally, the size of the completely assembled pacifier ball, or even a single hemispherical member 11, 21 with its protruding nipples, is too large for an infant to put completely into its mouth and becoming choked.

Figure 5:
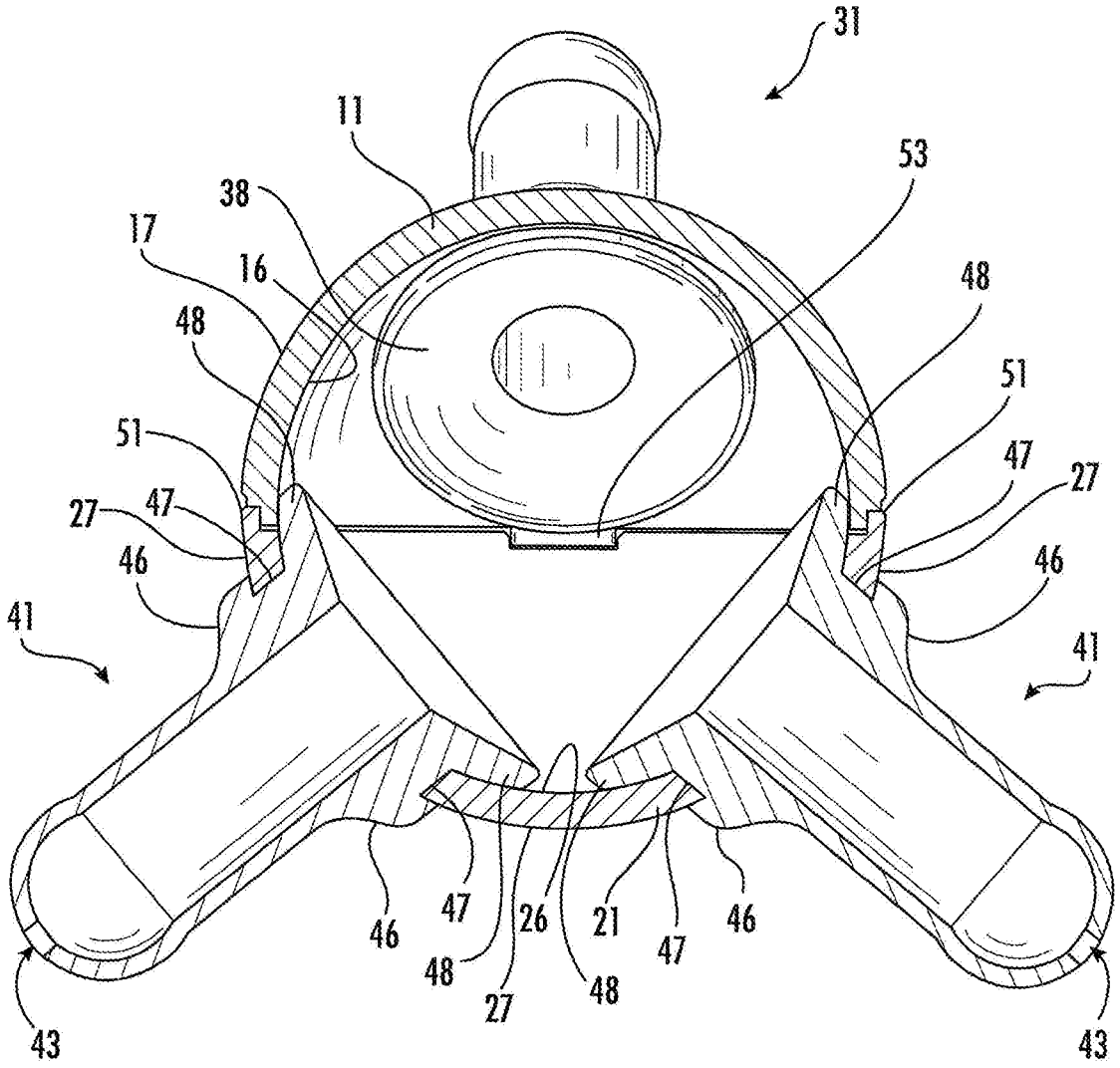
FIG. 5 is cross sectional view of the present invention as shown along line 5-5 in FIG. 1.
Figure 6:
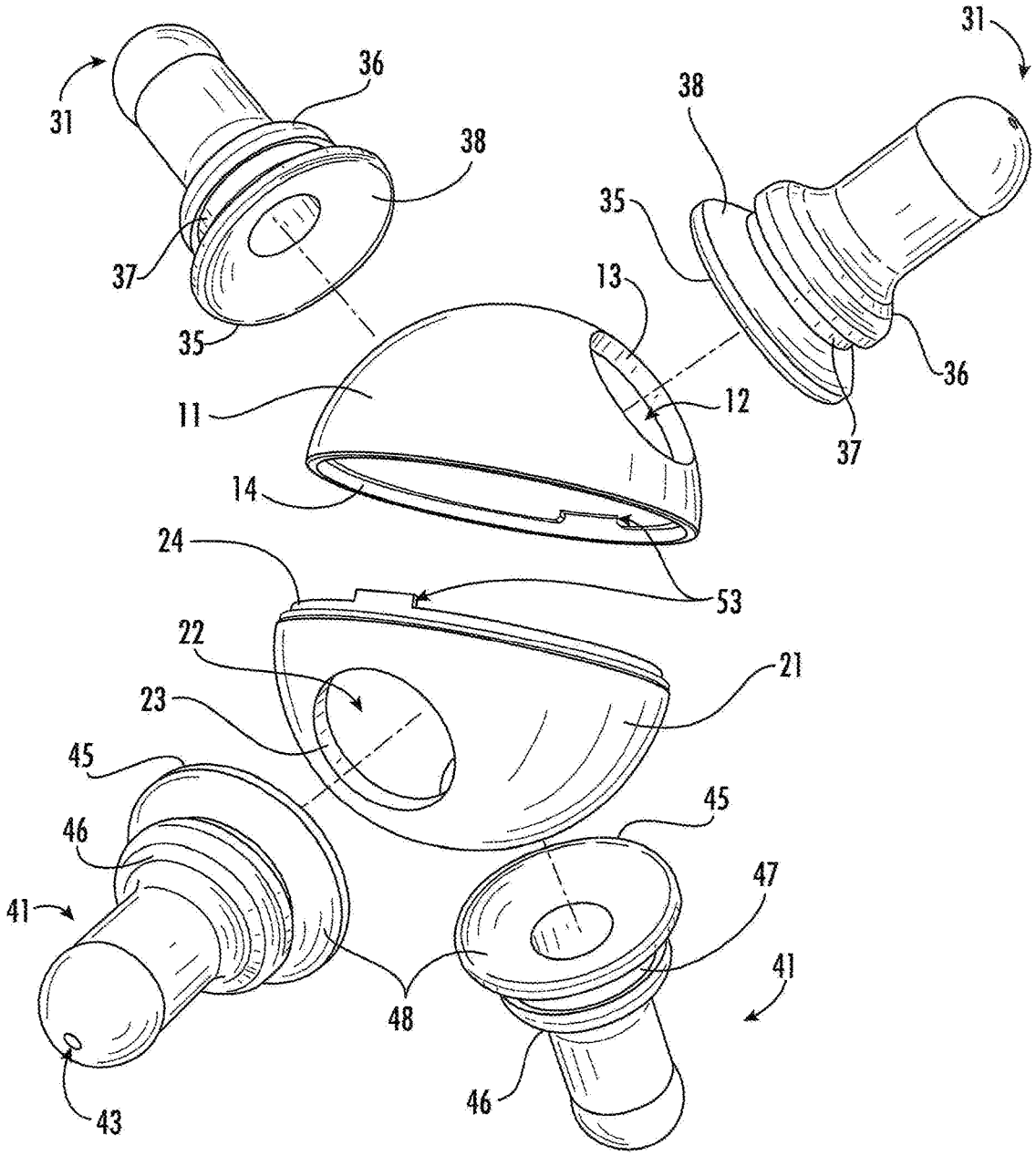
FIG. 6 is an exploded view illustrating the various components of the present invention.

Referring primarily to FIGS. 5 and 6, securing first pair of hollow pliable nipples 31 to the first hemispherical member 11 and securing the second pair of hollow pliable nipples 41 to the second hemispherical member 21 is accomplished in the same manner. In a preferred embodiment of the present invention the hollow pliable nipples 31, 41 are constructed of medical grade silicone, or such other similar product safe for an infant to suckle. Since the nipples are made to be pliable and therefore soft to the touch of an infant's mouth, the nipple can be manually deformed and urged into a nipple opening 12, 22 such that the retaining groove 37, 47 is in communication with the nipple opening rim 13, 23. On ending the deformation the retaining groove 37, 47 securely engages the nipple opening rim 13, 23 the nipple shoulder 36, 46 securely engages the hemispherical outer surface 17, 27, and the circular flanged inner end 38, 48 securely engages the first hemispherical inner surface 16, 26. The diameter of the nipple shoulder 36, 46 being greater than the diameter of the nipple opening 12, 22 prevents the nipple from being pushed into the hollow sphere by an infant when suckling the pacifier ball. Similarly, the diameter of the circular flanged inner end 38, 48 of the nipple is also greater than the diameter of the nipple opening 12, 22 and as such the nipple does not come out of the nipple opening when suckled by an infant. The nipple shoulder-retaining groove-circular flanged inner end configuration keeps the nipple securely attached within the nipple opening 12, 22 when being suckled by an infant and prevents the infant from taking the pacifier ball apart into its original pre-assembly components which would increase the risk of infant choking.

Once the first pair of hollow pliable nipples 31 are attached to the first pair of nipple opening rims 13 on the first hemispherical member 11, they project radially outward from the first pair nipple openings 12. The configuration of the first pair of hollow pliable nipples 31 is such that the nipples of the first pair of nipples 31 have centerlines projecting through the center of the hollow sphere and define therewith a first common plane. The centerlines of the nipples of the first pair of nipples 30 create an angle of separation (a) between said nipples. These centerlines also create two equal angles of projection (b) in relation to the first hemispherical rim 14 for each of the nipples such that each nipple is the same distance from the first hemispherical rim 14.

Figure 4:
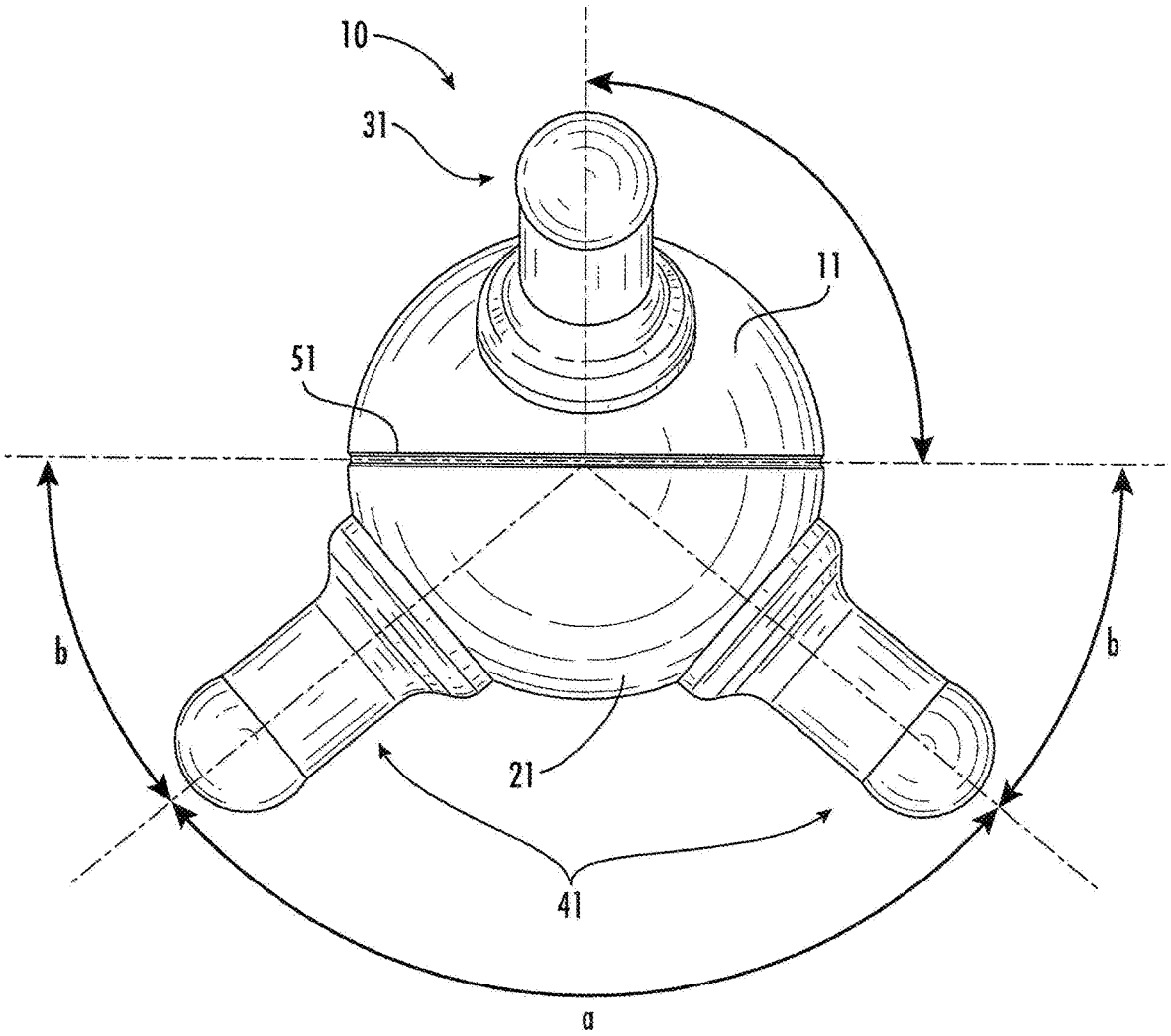
FIG. 4 is an elevation view of the present invention illustrating the angular relationships between the nipples of the pacifier ball.

The preferred embodiment of the present invention also includes a second pair of hollow pliable nipples 41 mounted to the second hemispherical member 21 in the same manner and configuration as the first pair of hollow pliable nipples 31 to the first hemispherical member 11. As illustrated in FIG. 4, the configuration of the second pair of hollow pliable nipples 41 is such that the nipples of the second pair of nipples 41 have centerlines projecting through the center of the hollow sphere 20 and define therewith a second common plane. The centerlines of the nipples of the second pair of nipples 41 create an angle of separation (a) between said nipples. These centerlines also create two equal angles of projection (b) in relation to the second hemispherical rim for each of the nipples such that each nipple is the same distance from the second hemispherical rim 24. The angle of separation (a) for the first pair of hollow pliable nipples 31 is the same as the angle of separation (a) for the second pair of hollow pliable nipples 41 and the angles of projection (b) for the first pair of hollow pliable nipples 31 are the same as the angles of projection (b) for the second pair of hollow pliable nipples 41. In a preferred embodiment of the present invention the angle of separation (a) for the first and second pairs of hollow pliable nipples 31, 41 is about 95 degrees to about 105 degrees. The preferred angle of separation (a) is 100 degrees with the preferred angles of projection (b) being 40 degrees. An alternative embodiment for the present invention includes a configuration in which each hemispherical member 11, 21 together with its respective nipples 31, 41 is made as a single molded component which would be separably joined to the other hemispherical component in similar fashion as the previously discussed multiple component pacifier ball. The function and usefulness of such a pacifier ball should not be affected by the different manufacturing process.

The placement and configuration of the hollow pliable nipples 31, 41 on the hemispherical members 11, 21 allow the infant to suckle any nipple without an adjacent nipple contacting the infant's nose and possibly interfering with the infant's breathing. The placement and configuration of the nipples on the hemispherical members also provides that only the rounded surface of the hollow sphere is opposite to any nipple on which the infant may be suckling. This configuration prevents a nipple from being pushed further into an infant's mouth should the infant be suckling nipple in a face-down position. The number of nipples extending from the present invention insures that the pacifier ball is not likely to roll out of the reach of the infant should the nipple come out of the infant's mouth. Also, in light of the number of nipples on the pacifier ball and the absence of a pacifier holding surface or ring it is not likely that an infant will not be able to find a nipple to suckle The present invention includes a means for separably joining the first hemispherical member 11 to the second hemispherical member 21. One such preferred embodiment of the present invention may include at least one snap and click type of fastener incorporated into the hemispherical rims of the first and second hemispherical members 11, 21. Such a fastener includes a small arm member with an edge extending from one hemispherical rim and a raised edge portion on the other hemisphere's inner service adapted to releasably engage the arm member of the other hemispherical member. Another separably joining embodiment may include a twist and snap fastener in which one hemispherical rim 14, 24 incorporates a small raised member adapted to be received by a buckle feature incorporated into the other hemispherical rim. Yet another separably joining means may include each hemispherical member having complementary hemispherical rim lips 14, 24 each having a raised edge adapted to engage the lip edge of the other hemispherical member when the two hemispherical rims are pressed together. Yet another separably joining means may include a screw-threaded engagement incorporated into the hemispherical rims of the present invention. Each means of separably joining the present invention's includes a manner in which the joined hemispherical members are separated. Since the hemispherical members are made from a polymer having a certain degree of rigidity, such manner includes the slight deformation of the hemispherical members with the application of manual pressure to disengage the fastening mechanism. It is especially important to note that each separably joining means is configured such that when the first hemispherical member 11 is joined to the second hemispherical member 21 the first common plane in which said first pair of hollow pliable nipples 31 lie is perpendicular to said second common plane in which said second pair of hollow pliable nipples 41 lie. The ability to separate the hemispherical components of the present invention from, one another and then rejoin the hemispherical components 11, 21 back to their intended configuration is an important aspect for the pacifier ball. This feature makes it possible to clean the interior of the present invention to maintain it in a state of cleanliness. Since one preferred embodiment of the present invention includes an aperture 33, 43 located at the outermost tip portion 39, 49 of at least one of the hollow pliable nipples 31, 41, it is likely that an infant's saliva may enter the hollow sphere 20 over time, and as such necessitate cleaning the interior spaces of the pacifier ball.

In the event the present invention exists as a closed device and system, the possibility exists that the pacifier ball may become deformed due to atmospheric pressure changes often encountered during air travel or such other activities that may experience changes in atmospheric pressure. A preferred embodiment of the present invention includes a means for equalization of air pressure within said hollow sphere. One such embodiment comprises an aperture 33, 43 located in at least one of the outermost tip portions 39, 49 of the hollow pliable nipples 31, 41. The aperture 33, 43 provides for the passage of air through the hollow pliable nipple 31, 41 to the interior space of the hollow sphere 20 as necessary to maintain pressure equalization. Alternatively, an aperture 33, 43 may be located on either of hemispherical members 11, 21 to allow for the passage of air directly into the interior space of the hollow sphere 20 which is in communication with the hollow pliable nipples 31,41 and thus allow for pressure equalization with the hollow pliable nipples as well.

The above discussion discloses various embodiments of the of the present invention and the benefits and aspects associated with such embodiments. One such key aspect of one preferred embodiment for the present invention is the orientation of the first hemispherical member 11 to the second hemispherical member 21 when the first hemispherical rim 14 is joined to the second hemispherical rim 24. When the first hemispherical member 11 is joined to the second hemispherical member 21 the first common plane in which said first pair of hollow pliable nipples 31 lie is perpendicular to said second common plane in which said second pair of hollow pliable nipples 41 lie. It is this perpendicular orientation of each pair of hollow pliable nipples 31, 41 that prevents an un-used nipple from coming into contact with an infant's nose and possibly becoming a breathing obstruction when an infant is suckling a nipple on the present invention. Other beneficial aspects of other embodiments of the present invention include the size and weight of the present invention with regard to the ability of an infant being able to manipulate the pacifier ball. Likewise, the methods and materials used in the manufacture of the present invention are important to establishing an economic production of the pacifier ball. The ability to easily separate the present invention into its separate hemispherical members is important to being able to maintain the pacifier ball in a state of cleanliness.

Although preferred embodiments of the present invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged either in whole, or in part. Therefore, the spirit and scope of the invention should not be limited to the description of the preferred embodiments contained herein.

What is claimed is:

1. A pacifier ball for infants comprising:

a hollow sphere comprising:

a) a first hemispherical member having a first pair of nipple openings defined by a first pair of nipple opening rims, a first hemispherical rim, a first hemispherical outer surface, and a first hemispherical inner surface, wherein each of said first pair of nipple openings having a diameter equal to the other, b) a second hemispherical member having a second pair of nipple openings defined by a second pair of nipple opening rims, a second hemispherical rim, a second hemispherical outer surface, and a second hemispherical inner surface, wherein each of said second pair of nipple openings having a diameter equal to said diameters of said first pair of nipple openings;

c) a first pair of hollow pliable nipples secured to said first pair of nipple opening rims and projecting radially outward from said first pair of nipple openings of said first hemispherical member, said nipples of said first pair of nipples having centerlines projecting through the center of said hollow sphere and defining therewith a first common plane, said centerlines of said nipples of said first pair of nipples creating an angle of separation between said nipples and equal angles of projection for each of said nipples wherein each of said nipples is equally spaced from said first hemispherical rim, whereby said angle of separation is about 95 degrees to about 105 degrees;

d) a second pair of hollow pliable nipples secured to said second pair of nipple opening rims and projecting radially outward from said second pair of nipple openings of said second hemispherical member, said nipples of said second pair of nipples having centerlines projecting through the center of said hollow sphere and defining therewith a second common plane, said centerlines of said nipples of said second pair of nipples creating an angle of separation between said nipples and an angle of projection for each of said nipples wherein each of said nipples is equally spaced from said second hemispherical rim, wherein both of said first and second pairs of hollow pliable nipples having equal angles of separation and equal angles of projection;

e) a means for separably joining said first hemispherical member to said second hemispherical member to form said hollow sphere, whereby said first common plane in which said first pair of hollow pliable nipples lie is perpendicular to said second common plane in which said second pair of hollow pliable nipples lie; and f) a means for equalization of air pressure within said hollow sphere, wherein said hollow sphere having an interior space in communication with said hollow pliable nipples.

2. The pacifier ball for infants of claim 1, wherein said angle of separation for both of said first and second pairs of hollow pliable nipples is 100 degrees and said angle of projection both of said first and second pairs of hollow pliable nipples is 40 degrees.

3. The pacifier ball for infants of claim 1, wherein said hollow sphere having a diameter of about 1.68 inches.

4. The pacifier ball for infants of claim 1, wherein each nipple of said pairs of hollow pliable nipples comprising a bulbous outer end having an outermost tip portion, a tubular stem portion connecting said bulbous outer end to a nipple shoulder having a diameter, said nipple shoulder adapted to securely engage said hemispherical outer surfaces, a retaining groove adjacent to said nipple shoulder said retaining groove adapted to securely engage said nipple opening rim of said nipple opening having a diameter, and a circular flanged inner end having a diameter adjacent to said retaining groove, said circular flanged inner end adapted to securely engage said hemispherical inner surfaces, said diameter of the nipple shoulder and the diameter of the circular flanged inner end being greater than said diameter of the nipple opening such that each of said nipples is attached to each of said hemispherical members.

5. The pacifier ball for infants of claim 1, wherein said means for equalization of air pressure within said hollow sphere comprising an aperture located within at least one of said outmost tip portion of said bulbous outer end of the first and second pairs of hollow pliable nipples, said aperture permitting the passage of air into or out of said pacifier ball.

6. A pacifier ball for infants comprising:

a hollow sphere consisting essentially of a) a first hemispherical member having a first pair of nipple openings defined by a first pair of nipple opening rims, a first hemispherical rim, a first hemispherical outer surface, and a first hemispherical inner surface, wherein each of said first pair of nipple openings having a diameter equal to the other, b) a second hemispherical member having a second pair of nipple openings defined by a second pair of nipple opening rims, a second hemispherical rim, a second hemispherical outer surface, and a second hemispherical inner surface, wherein each of said second pair of nipple openings having a diameter equal to said diameters of said first pair of nipple openings of said first hemispherical member;

c) a first pair of hollow pliable nipples secured to said first pair of nipple opening rims and projecting radially outward from said first pair of nipple openings of said first hemispherical member, said nipples of said first pair of nipples having centerlines projecting through the center of said hollow sphere and defining therewith a first common plane, said centerlines of said nipples of said first pair of nipples creating an angle of separation between said nipples and equal angles of projection for each of said nipples wherein each of said nipples is equally spaced from said first hemispherical rim, wherein each nipple of said first pair of hollow pliable nipples comprising a bulbous outer end having an outermost tip portion, a tubular stem portion connecting said bulbous outer end to a nipple shoulder, said nipple shoulder adapted to securely engage said first hemispherical outer surface, a retaining groove adjacent to said nipple shoulder, said retaining groove adapted to securely engage said nipple opening rim of said nipple opening, and a circular flanged inner end adjacent to said retaining groove, said circular flanged inner end adapted to securely engage said first hemispherical inner surface of said first hemispherical member, d) a second pair of hollow pliable nipples secured to said second pair of nipple opening rims and projecting radially outward from said second pair of nipple openings of said second hemispherical member, said nipples of said second pair of nipples having centerlines projecting through the center of said hollow sphere and defining therewith a second common plane, said centerlines of said nipples of said second pair of nipples creating an angle of separation between said nipples and an angle of projection for each of said nipples wherein each of said nipples is equally spaced from said second hemispherical rim, wherein both of said first and second pairs of hollow pliable nipples having equal angles of separation and equal angles of projection, wherein each nipple of said second pair of hollow pliable nipples comprising a bulbous outer end having an outermost tip portion, a tubular stem portion connecting said bulbous outer end to a nipple shoulder, said nipple shoulder adapted to securely engage said second hemispherical outer surface, a retaining groove adjacent to said nipple shoulder, said retaining groove adapted to securely engage said nipple opening rim of said nipple opening, and a circular flanged inner end adjacent to said retaining groove, grove said circular flanged inner end adapted to securely engage said second hemispherical inner surface of said second hemispherical member, d) a means for separably joining said first hemispherical member to said second hemispherical member to form said hollow sphere, whereby said first common plane in which said first pair of hollow pliable nipples lie is perpendicular to said second common plane in which said second pair of hollow pliable nipples lie; and e) a means for equalization of air pressure within said hollow sphere, said hollow sphere having an interior space in communication with said hollow pliable nipples, comprising an aperture located within at least one of said outmost tip portion of said bulbous outer end of the first and second pairs of hollow pliable nipples, said aperture permitting the passage of air into or out of said pacifier ball.

7. The pacifier ball for infants of claim 6, wherein said angle of separation for each pair of hollow pliable nipples being equal to one another and said angle is about 95 degrees toy about 105 degrees.

8. The pacifier ball for infants of claim 6, wherein said angle of separation for each pair of hollow pliable nipples is 100 degrees and said angle of projection for each of said nipples is 40 degrees.

9. The pacifier ball for infants of claim 6, wherein said first and second hemispherical members are molded from a polymer and over molded with a layer of silicone.

10. The pacifier ball for infants of claim 6, wherein said first and second pairs of hollow pliable nipples are manufactured from a medical grade silicone.

11. The pacifier ball for infants of claim 6, wherein said hollow sphere having a diameter of about 1.68 inches.

12. A method of using a pacifier ball for infants comprising the steps of:

a) providing a hollow sphere comprising:

i) a first hemispherical member having a first pair of nipple openings defined by a first pair of nipple opening rims, a first hemispherical rim, a first hemispherical outer surface, and a first hemispherical inner surface, each of said first pair of nipple openings having a diameter equal to the other, wherein said first hemispherical member is molded from a polymer and over molded with a silicone layer;

ii) a second hemispherical member having a second pair of nipple openings defined by a second pair of nipple opening rims, a second hemispherical rim, a second hemispherical outer surface, and a second hemispherical inner surface, each of said second pair of nipple openings having a diameter equal to said diameters of said first pair of nipple openings, wherein said first and second hemispherical members are molded from a polymer and over molded with a silicone layer;

iii) a first pair of hollow pliable nipples for attachment to said first pair of nipple opening rims and projecting radially outward from said first pair of nipple openings of said first hemispherical member, said nipples of said first pair of nipples having centerlines projecting through the center of said hollow sphere and defining therewith a first common plane, said centerlines of said nipples of said first pair of nipples creating an angle of separation between said nipples and equal angles of projection for each of said nipples wherein each of said nipples is equally spaced from said first hemispherical rim, whereby said angle of separation is about 95 degrees to about 105 degrees;

wherein each nipple of said first pair of hollow pliable nipples comprising a bulbous outer end having an outermost tip portion, a tubular stem portion connecting said bulbous outer end to a nipple shoulder, said nipple shoulder adapted to securely engage said first hemispherical outer surface, a retaining groove adjacent to said nipple shoulder said retaining groove adapted to securely engage said nipple opening rim of said nipple opening, and a circular flanged inner end adjacent to said retaining groove said circular flanged inner end adapted to securely engage said first hemispherical inner surface of said first hemispherical member;

iv) a second pair of hollow pliable nipples for attachment to said second pair of nipple opening rims and projecting radially outward from said second pair of nipple openings of said second hemispherical member, said nipples of said second pair of nipples having centerlines projecting through the center of said hollow sphere and defining therewith a second common plane, said centerlines of said nipples of said second pair of nipples creating an angle of separation between said nipples and an angle of projection for each of said nipples wherein each of said nipples is equally spaced from said second hemispherical rim, wherein both of said first and second pairs of hollow pliable nipples having equal angles of separation and equal angles of projection, wherein each nipple of said second pair of hollow pliable nipples comprising a bulbous outer end having an outermost tip portion, a tubular stem portion connecting said bulbous outer end to a nipple shoulder, said nipple shoulder adapted to securely engage said second hemispherical outer surface, a retaining groove adjacent to said nipple shoulder, said retaining groove adapted to securely engage said nipple opening rim of said nipple opening, and a circular flanged inner end adjacent to said retaining groove said circular flanged inner end adapted to securely engage said second hemispherical inner surface of said second hemispherical member;

v) a means for separably joining said first hemispherical member to said second hemispherical member to form said hollow sphere; and vi) a means for equalization of air pressure within said hollow sphere, said hollow sphere having an interior space in communication with said hollow pliable nipples;

b) securing said first pair of hollow pliable nipples to said first hemispherical member by deforming and urging said nipples into the nipple openings of said first hemispherical member such that the retaining groove is in communication with the nipple opening rim whereby ending deformation the retaining groove of said nipple securely engages the nipple opening rim, the nipple shoulder securely engages the hemispherical outer surface, and the flanged inner end securely engages the first hemispherical inner surface;

c) securing said second pair of hollow pliable nipples to said second hemispherical member by deforming and urging said nipples into the nipple openings of said second hemispherical member such that the retaining groove of said nipple is in communication with the nipple opening rim whereby ending deformation the retaining groove securely engages the nipple opening rim, the nipple shoulder securely engages the hemispherical outer surface, and the flanged inner end securely engages the first hemispherical inner surface;

d) aligning said first hemispherical rim with said second hemispherical rim and locking first and second hemispherical rims into position, whereby said first plane of said first pair of hollow pliable nipples is perpendicular to said second plane of said second pair of hollow pliable nipples;

e) providing said pacifier ball to an infant for suckling;

f) retrieving said pacifier ball from said infant;

g) separating said first hemispherical member from said second hemispherical member; and i) washing said first and second hemispherical members and said first and second pairs of hollow pliable nipples in preparation of next use of said pacifier ball.

* * * * *